US006257844B1

(12) United States Patent
Stern

(10) Patent No.: US 6,257,844 B1
(45) Date of Patent: Jul. 10, 2001

(54) PUMP DEVICE FOR PUMPING LIQUID FOODSTUFF

(75) Inventor: Leif Einar Stern, Lomma (SE)

(73) Assignee: Asept International AB, Lund (SE)

( * ) Notice: Subject to any disclaimer, the term of this patent is extended or adjusted under 35 U.S.C. 154(b) by 0 days.

(21) Appl. No.: 09/406,157

(22) Filed: Sep. 27, 1999

(30) Foreign Application Priority Data

Sep. 28, 1998 (SE) ..... 9803273

(51) Int. Cl.[7] ..... F04B 9/08

(52) U.S. Cl. ..... 417/383; 417/394; 222/82; 222/334; 222/386.5

(58) Field of Search ..... 417/383, 394, 417/521; 222/82, 83, 334, 386.5

(56) References Cited

U.S. PATENT DOCUMENTS 2,033,210 * 3/1936 Tennant et al. ..... 417/383
3,212,447 * 10/1965 Browne ..... 417/383
4,120,424 10/1978 Zygiel .
4,603,793 8/1986 Stern .

FOREIGN PATENT DOCUMENTS 577401 5/1993 (DE) .
0390298 10/1990 (EP) .
276735 * 7/1970 (SU) ..... 417/383

* cited by examiner

*Primary Examiner*—Cheryl J. Tyler
(74) *Attorney, Agent, or Firm*—McCormick, Paulding & Huber LLP

(57) ABSTRACT

A pump device for pumping liquid foodstuff includes a pump housing having an inlet and an outlet for pumping the foodstuff therethrough. A pump body is disposed within the pump housing having an elastic member which contains a predetermined volume of pressurized liquid. The pressurized liquid expands the elastic member from an unpressurized normal shape to a prestressed shape. The volume of liquid contained within the elastic member remains substantially fixed while the elastic member expands from its prestressed shape to a stretched shape to pump a predetermined amount of foodstuff out of the outlet.

13 Claims, 1 Drawing Sheet

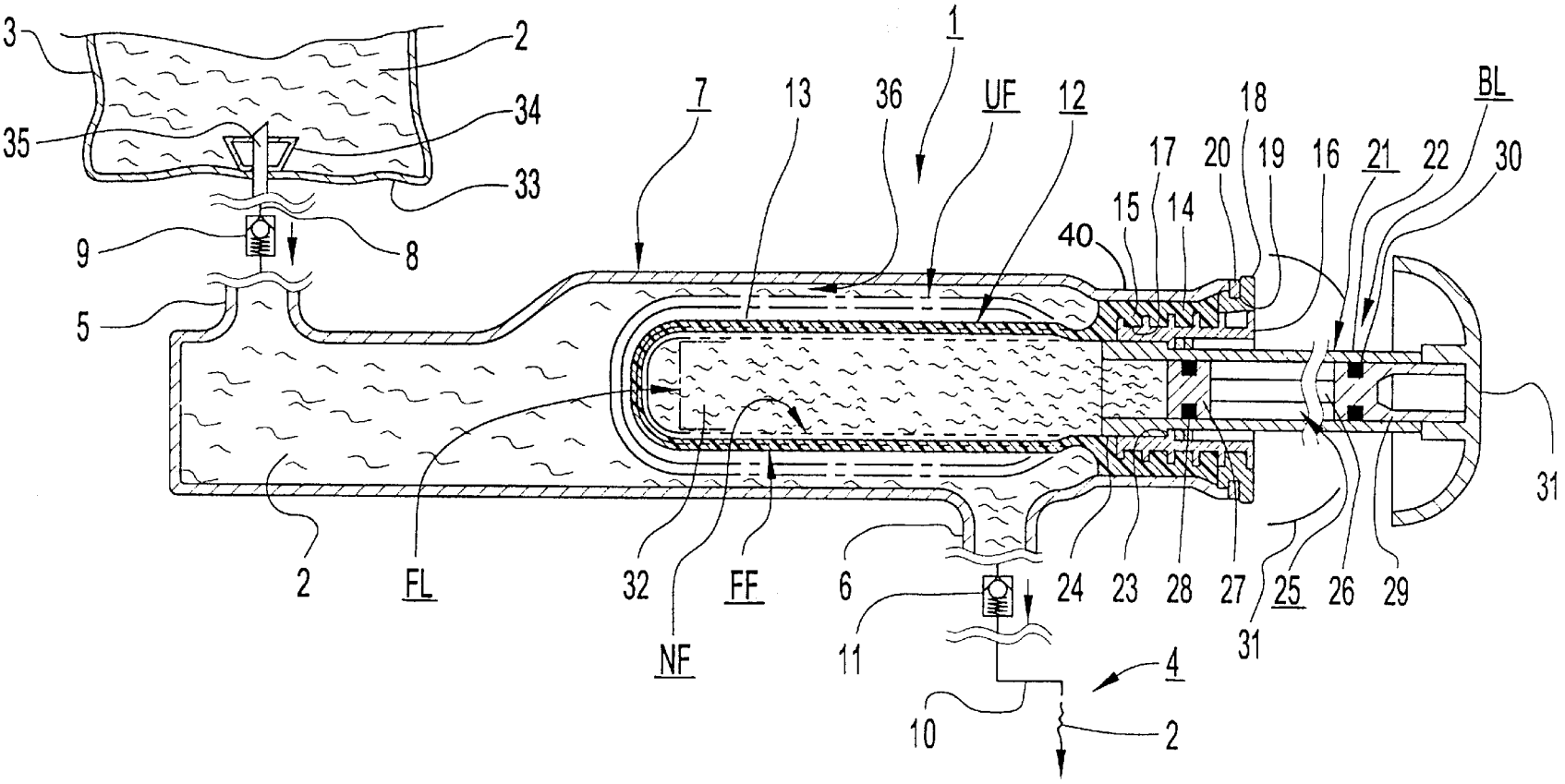
31
BL
30
22
21
16
19
18
20
17
14
15
40
12
UF
1
36
13
7
2
34
33
3
35
8
9
5
2
FL
32
NF
FF
6
11
10
2
4
23
24
28
27
31
25
26
29

PUMP DEVICE FOR PUMPING LIQUID FOODSTUFF

FIELD OF THE INVENTION

The present invention relates to a pump device for pumping liquid foodstuff, e.g. ketchup, mustard, sauce, dressing or similar, wherein the pump device includes a pump housing, an inlet, an outlet, a pump body and at least one pump means, wherein the pump body has an elastic member which by means of the pump means can be stretched for imparting pump movements thereon for pumping foodstuff out of the pump housing through the outlet, and wherein the elastic member of the pump body is provided to perform, through contraction, suction movements for sucking foodstuff into the pump housing through the inlet.

BACKGROUND OF THE INVENTION

A pump device for foodstuff of this type is already known from U.S. Pat. No. 4,961,508 and the object of the present invention is to improve these pump devices such that one therewith can feed or discharge exactly the same amounts of foodstuff during each portioning step. A similar pump device, but for other substances than foodstuff is known from EP 0 390 298.

SUMMARY OF THE INVENTION

In an exemplary embodiment of the present invention a pump device for pumping liquid foodstuff is presented. The pump device includes a pump housing having an inlet and an outlet for pumping the foodstuff therethrough. A pump body is disposed within the pump housing having an elastic member which contains a predetermined volume of pressurized liquid. The pressurized liquid expands the elastic member from an unpressurized normal shape to a prestressed shape. The volume of liquid contained within the elastic member remains substantially fixed while the elastic member expands from its prestressed shape to a stretched shape to pump a predetermined amount of foodstuff out of the outlet.

Since the pump device according to the invention is provided with said characterizing features, it is attained that one for sure can feed or discharge exactly the same amounts of foodstuff during each portioning step, and that the elastic member of a pump body forming part of the pump device is prestressed such that said elastic member can contract to the same extent after every pump movement.

The invention will be further described below with reference to the accompanying drawing, which is a section through the pump device according to the invention.

DETAILED DESCRIPTION OF THE PREFERRED EMBODIMENT

The pump device 1 illustrated in the drawing is adapted for sucking liquid foodstuff 2, e.g. ketchup, mustard, sauce, dressing or similar, from a foodstuff container 3 to a discharge or dispensing device 4 for discharge through said device 4. The pump device 1 includes an inlet 5, an outlet 6 and a pump housing 7. The inlet 5 is through a hose 8 or similar connected to the foodstuff container 3 such that foodstuff 2 through the hose 8 can be sucked into the pump housing 7. A non-return valve 9 can be provided on the hose 8 for allowing foodstuff 2 to be sucked from the foodstuff container 3 to the pump housing 7, but not pressed in the opposite direction. A hose to the discharge device 4 is connected to the outlet 6 for discharge of the foodstuff 2. A non-return valve 11 can be provided on the hose 10 for allowing foodstuff 2 to pass out from the pump housing 7 to the discharge device 4 but not in the opposite direction.

The pump device 1 further includes a pump body 12 with an elastic member 13 and a retaining member 14. The elastic member 13 and the retaining member 14 can be formed in one piece of the same elastic or flexible material, e.g. elastic plastic material or caoutchouc. The elastic member 13 and the retaining member 14 preferably have the shape of an elongated tube which is open at the retaining member 14, but closed at the opposite end. The retaining member 14 has inwardly directed retaining portions 15, e.g. in the form of circular flanges 15, and it is threaded onto a retaining ring 16 having corresponding retaining portions 17, e.g. in the form of circular grooves in which the flanges 15 are sealingly engaged.

The pump body 12 is inserted into the pump housing 7 such that the elastic member 13 is located in such a portion of the pump housing 7 which has a larger inner diameter than the elastic member 13, while the retaining member 14 is situated in another portion 40 of the pump housing 7 which it engages with sealing. Hereby, the retaining member 14 of the pump body 12 defines a sealing member between the pump housing 7 and the retaining ring 16. An outer ring 18 can be provided on the retaining ring 16 and may have a groove 19 in which an outer flange 20 or a corresponding portion of the pump housing 7 is engaged.

The pump device 1 includes a pump means 21 which is dimensioned for displacement from a rear position BL into the elastic member 13 to a front position FL (indicated with dashed and dotted lines), at which it reaches the front portion of the elastic member 13. Said pump means 21 has an outer piston 22 which is inserted into the retaining ring 16 and which is displaceably mounted relative thereto as well as relative to the elastic member 13.

The outer piston 22 is guided by an inwardly directed guide portion 23 and has at a front outer end an outwardly guide portion 24 which cooperates with the pump body 12 for guiding the outer end of the pump means 21 when said pump body 12 is completely or almost completely drawn or pulled out from the elastic member 13.

When the pump means 21 is drawn out, the outwardly directed guide portion 24 on the outer piston 22 bumps into the inwardly directed guide portion 23 on the retaining ring 16, whereby it is ensured that the pump means 21 can not be removed from the retaining ring 16.

The pump device 1 also has a prestressing device 25 which at the illustrated embodiment includes an inner piston 26 located inside the outer piston 22. The inner piston 26 has a front end portion 27 with a sealing device 28, e.g. a sealing ring, which provides for sealing between the front end portion 27 of the inner piston 26 and the outer piston 22. The inner piston 26 also has a rear end portion 29 with a retaining device 30, e.g. a friction ring or similar, for retaining said inner piston 26 at the outer piston 22 in their intended relative position. On the rear end portion 29 of the inner piston 26 there is also provided a pressure plate 31 against which pressure is applied for insertion of the pump means 21 into the pump body 12.

The prestressing device 25 is adapted to preload the elastic member 13 of the pump body 12 from a normal shape NF (shown with broken lines in the FIGURE) into a prestressed or preloaded shape FF (shown with unbroken lines in the figure). This preloading is obtained by pulling out the outer piston 22 as far as possible to the rear position BL and then by pulling out the inner piston 26 from the outer piston 22. Through the outer piston 22, liquid 32, e.g. water, is then poured into the elastic member 13 until said member and the outer piston 22 are filled with liquid. Thereafter, the inner piston 26 is pressed or pushed into the outer piston 22, which means that the inner piston 26 displaces and presses the liquid in the outer piston 22 into the elastic member 13, which thereby is preloaded from its normal shape NF to the prestressed or preloaded shape FF. The elastic member 13 has got its predetermined preloaded shape FF when the inner piston 26 is completely inserted into the outer piston 22, and this shape is maintained while the retaining device 30 retains the inner piston 26 in its entirety inserted position in the outer piston 22.

The pump device 1 is thereby assembled and ready for use for sucking foodstuff 2 from the foodstuff container 3 and pump it through the pump housing 7 to the discharge device 4. This is done by first sucking foodstuff 2 into the pump housing 7 until said housing is filled. Then, identical amounts of foodstuff 2 can be pumped out during each pumping step by pressing the pump means 21 inwards from the rear position BL to the front position FL. Hereby, the pump means 21 will, through the liquid, stretch the elastic member 13 from its preloaded shape FF into a stretched shape UF, whereby foodstuff 2 is pumped out from the pump housing 7 and through the outlet 6 and the discharge device 4 out of the pump device 1. When the pump means 21 is released, the elastic member 13 will, due to its elastic properties, contract from the stretched shape UF into the prestressed or preloaded shape FF, whereby a new amount of foodstuff 2 is sucked from the foodstuff container 3 into the pump housing 7 while at the same time the pump means 21, through the liquid, is pressed back to its rear position BL. This procedure is repeated until a sufficient amount of foodstuff 2 has been pumped out or discharged.

In its stretched shape UF, the elastic member 13 preferably has such an outer diameter or corresponding which is less than the inner diameter or corresponding of the surrounding portions of the pump housing 7. Hereby, there will be a space 36 around the elastic member 13 for foodstuff 2 when said member is stretched to its stretched shape UF.

The outlet 6 may be provided in said portions of the pump housing 7 and since the elastic member 13 can not expand to said portions, it can not obstruct the outlet 6.

The foodstuff container 3 can be of the type consisting of a flexible wall material 33, i.e. the foodstuff container 3 may be of plastic bag type. Inside the foodstuff container 3, on an unbroken portion of said wall material 33, there may be provided an inner connecting means 34. An outer connecting means 35 provided on the hose 8 or similar can be brought to penetrate the unbroken portion of the flexible wall material 33 and brought to attach to the inner connecting means 34. After this connecting procedure, foodstuff 2 can be sucked out from the foodstuff container 3 through an inner removal or discharge passage (not shown) in the outer connecting means 35.

The construction and function of the pump device described above may vary within the scope of the following claims. Thus, the elastic member 13 may be preloaded into a prestressed or preloaded shape FF in another way and with another device than the one described, the elastic member 13 may have another shape than as an elongated tube which is open in one end and closed in the opposite end, the elastic member may further be of another suitable elastic material than the one described above and the liquid may be another liquid than water.

What is claimed is:

1. A pump device for pumping liquid foodstuff, the pump device comprising:

a pump housing having an inlet and an outlet for pumping the foodstuff therethrough;

a pump body disposed within the pump housing having an elastic member which contains a predetermined volume of liquid; and a pump means containing a prestressing device for pressurizing the liquid to expand the elastic member from an unpressurized normal shape to a prestressed shape;

wherein, the volume of liquid contained within the elastic member remains substantially fixed while the elastic member expands from its prestressed shape to a stretched shape to pump a predetermined amount of foodstuff out of the outlet.

2. The pump device of claim 1 wherein the volume of liquid contained within the elastic member remains substantially fixed while the elastic member contracts from the stretched shape to the prestressed shape to receive the substantially same amount of foodstuff into the inlet.

3. The pump device of claim 1 comprising:

the pump means including an outer piston; and the prestressing device including an inner piston slidably disposed within the outer piston.

4. The pump device of claim 3 wherein the inner piston includes a front end portion with a sealing device for sealing between the front end portion and the outer piston.

5. The pump device of claim 4 wherein the sealing device is a sealing ring.

6. The pump device of claim 4 wherein the inner piston includes a rear portion with a retaining device for retaining the inner piston and the outer piston in their relative positions.

7. The pump device of claim 6 wherein the retaining device is a friction ring.

8. The pump device of claim 1 wherein the elastic member is free from contacting the pump housing when expanded to the stretched shape.

9. The pump device of claim 1 wherein the outlet is disposed on a portion of the pump housing surrounding the elastic member.

10. The pump device of claim 1 comprising:

the pump body including a retaining member sealingly engaged with an open end of the elastic member, the retaining member disposed against the pump housing; and a retaining ring disposed between the pump means and the sealing member.

11. The pump device of claim 10 wherein the elastic member and the retaining member of the pump body are a one piece construction of substantially the same elastic material.

12. The pump device of claim that 1 wherein the elastic member has generally an elongated tubular shape.

13. The pump device of claim 1 comprising a pressure plate against which pressure is applied for insertion of the pump means into the pump body.

* * * * *